US011077329B2

(12) United States Patent
Jones et al.

(10) Patent No.: US 11,077,329 B2
(45) Date of Patent: Aug. 3, 2021

(54) PLAY SYSTEMS HAVING BELT COMPONENTS

(71) Applicant: Landscape Structures Inc., Delano, MN (US)

(72) Inventors: Bryant A. Jones, St. Louis Park, MN (US); Thomas L. Keller, Minnetonka, MN (US); Timothy P. Kelly, Minneapolis, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

(21) Appl. No.: 16/431,826

(22) Filed: Jun. 5, 2019

(65) Prior Publication Data

US 2020/0384303 A1 Dec. 10, 2020

(51) Int. Cl.
*A63B 9/00* (2006.01)

(52) U.S. Cl.
CPC ..... *A63B 9/00* (2013.01); *A63B 2009/004* (2013.01); *A63B 2009/006* (2013.01); *A63B 2208/12* (2013.01)

(58) Field of Classification Search
CPC ..... A63B 9/00; A63B 2009/002–008; A63B 2208/12
See application file for complete search history.

(56) References Cited

U.S. PATENT DOCUMENTS 3,737,161 A * 6/1973 Taylor ..... A63B 9/00 482/35
4,442,920 A * 4/1984 Gronbeck ..... E06C 7/081 182/199
5,330,400 A * 7/1994 Huberman ..... A63B 9/00 482/121
5,554,074 A * 9/1996 Von Parrish ..... A63B 9/00 472/116
D413,957 S * 9/1999 Briggs ..... D21/826
6,019,547 A * 2/2000 Hill ..... A63G 31/007 4/491
6,228,005 B1 * 5/2001 Gray ..... A63B 21/068 482/148
6,443,849 B1 * 9/2002 Byrd ..... A63B 9/00 472/116
6,467,575 B1 * 10/2002 Chen ..... A62B 1/20 182/48
6,569,023 B1 * 5/2003 Briggs ..... A63B 9/00 104/70
D524,897 S * 7/2006 VanDeusen ..... D21/820
9,206,581 B2 * 12/2015 Mollick ..... E02D 27/32
9,770,637 B2 * 9/2017 Cranford ..... A63B 67/06
9,868,069 B2 * 1/2018 Keller ..... A63G 1/12
D809,619 S * 2/2018 Jackson ..... D21/826
(Continued)

*Primary Examiner* — Garrett K Atkinson
(74) *Attorney, Agent, or Firm* — Wesley Malherek; Kelly Holt & Christenson PLLC

(57) ABSTRACT

A play system includes a support structure, having a bottom end and a top end, vertically oriented relative to a surface such that the bottom end contacts the surface and the top end is above the surface. The play system includes a belt having flexible portions and rigid portions that forms an ascending structure around the inside of the support structure such that it ascends from the bottom end of the support structure to the top end of the support structure. The play system includes a plurality of clamps that couple the support structure and the belt.

19 Claims, 25 Drawing Sheets

(56) References Cited

U.S. PATENT DOCUMENTS

| | | | | |
|---|---|---|---|---|
| D814,589 | S * | 4/2018 | Eroglu | D21/826 |
| D844,164 | S * | 3/2019 | Cott | D25/1 |
| 2013/0090176 | A1* | 4/2013 | Ochi | A63G 31/08<br>472/29 |
| 2015/0217185 | A1* | 8/2015 | Cranford | A63B 67/06<br>273/355 |
| 2017/0165583 | A1* | 6/2017 | Keller | A63G 1/12 |

* cited by examiner

PLAY SYSTEMS HAVING BELT COMPONENTS

BACKGROUND

Playground play systems typically have "post and deck" structures, as well as bridge structures. There are limited options for getting to the top of the main structure of a playground component. Current playgrounds utilize stairs or other flat type deck systems for getting to the top of the playground, overhead event, to go down a slide, or otherwise experience the play system. It is now common practice to include structures that are suitable for all ability levels. Creating these structures can be difficult and are currently limited to few designs. It is desirable for future play systems to improve on the past designs but allow for use by everyone.

SUMMARY

A play system includes a support structure, having a bottom end and a top end, vertically oriented relative to a surface such that the bottom end contacts the surface and the top end is above the surface. The play system includes a belt having flexible portions and rigid portions that forms an ascending structure around the inside of the support structure such that it ascends from the bottom end of the support structure to the top end of the support structure. The play system includes a plurality of clamps that couple the support structure and the belt.

These and various other features and advantages that characterize the claimed embodiments will become apparent upon reading the following detailed description and upon reviewing the associated drawings.

DETAILED DESCRIPTION OF ILLUSTRATIVE EMBODIMENTS

Figure 1:
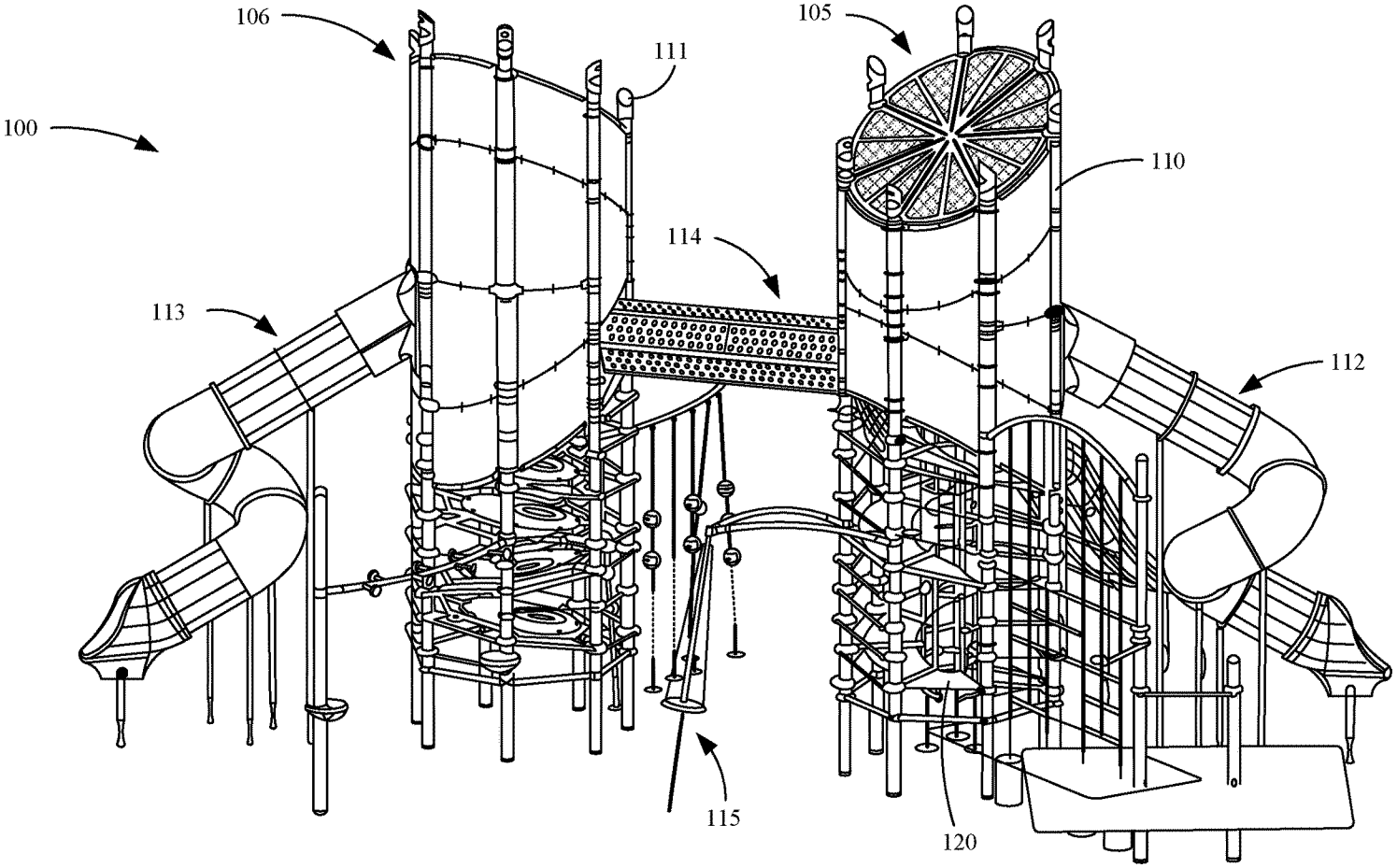
FIG. 1 is a perspective view of an example play system.

FIG. 1 is a perspective view of an example play system 100. Play system 100 illustratively includes support structure 110. Support structure 110 is the base system meant to support tower 105. Play system 100 also illustratively includes belt system 120 which is coupled to support structure 110 in a spiral fashion for a user to travel vertically on tower 105. Belt system 120, as shown, can be accessible to users of all ages and abilities.

Play system 100 also includes tower 106, support structure 111, slide 112, slide 113, bridge 114, spinner 115 and other components 116. Other components 116 include, but are not limited to, monkey bars, swings, standing swings, rope climbers, gymnastic bars, and additional slides. A specific configuration is provided as an example of the concept and is not intended to limit the scope of the present invention in any way. Those skilled in the art will appreciate that the components can be otherwise configured without departing from the scope of the present disclosure.

Figure 2:
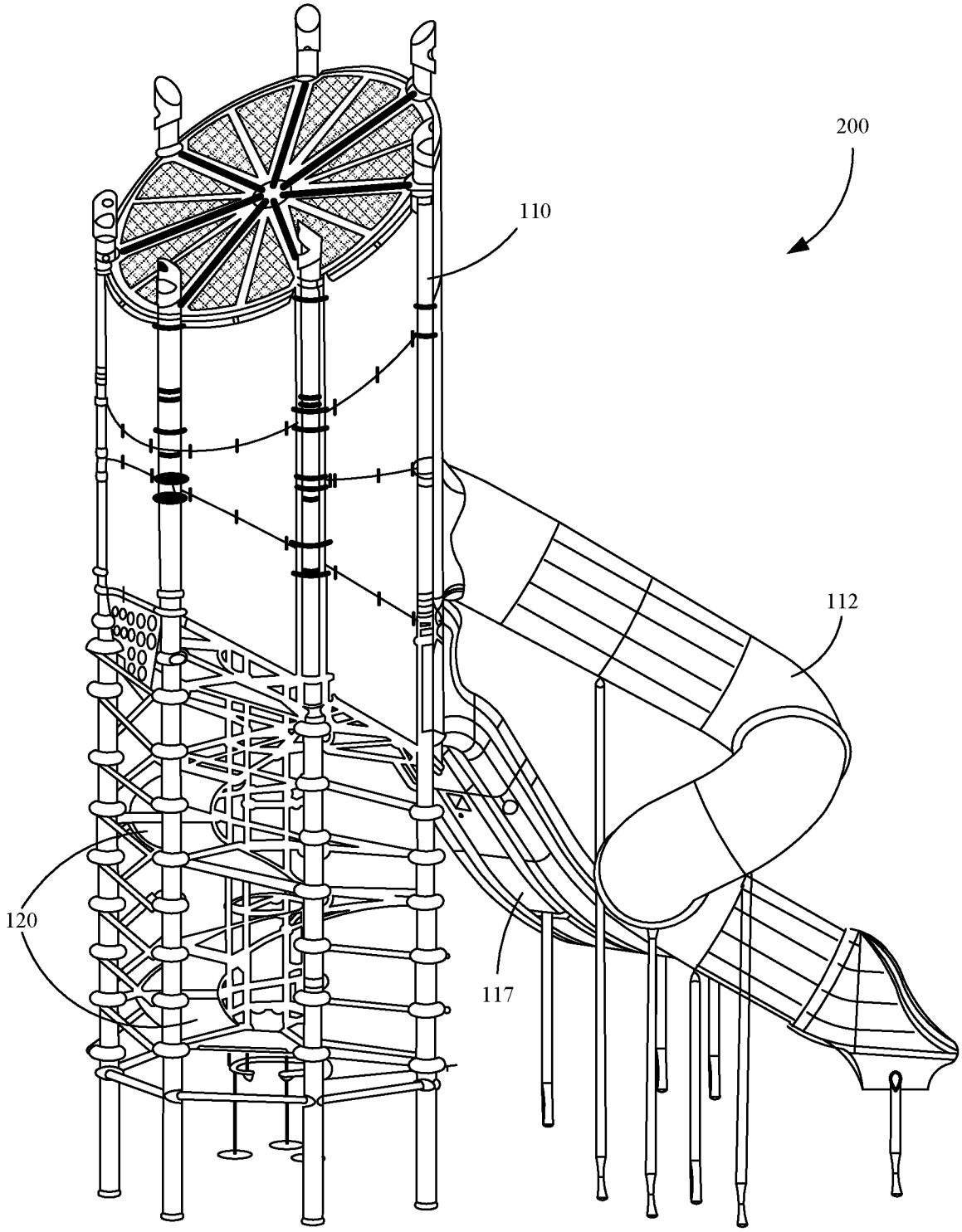
FIG. 2 is another perspective view of an example play system.

FIG. 2 is another perspective view of an example play system 200. Play system 200 illustratively includes support structure 110 and belt system 120. Play system 200 also includes slide 112 and slide 117 that are coupled to support structure 110 and/or belt system 120. Slides 112 and 117 are located at different heights along support structure 110 and both are accessible by ascending belt system 120. It should also be noted that the positioning of towers and components relative to one another as shown and described herein are illustrative examples only.

Figure 3:
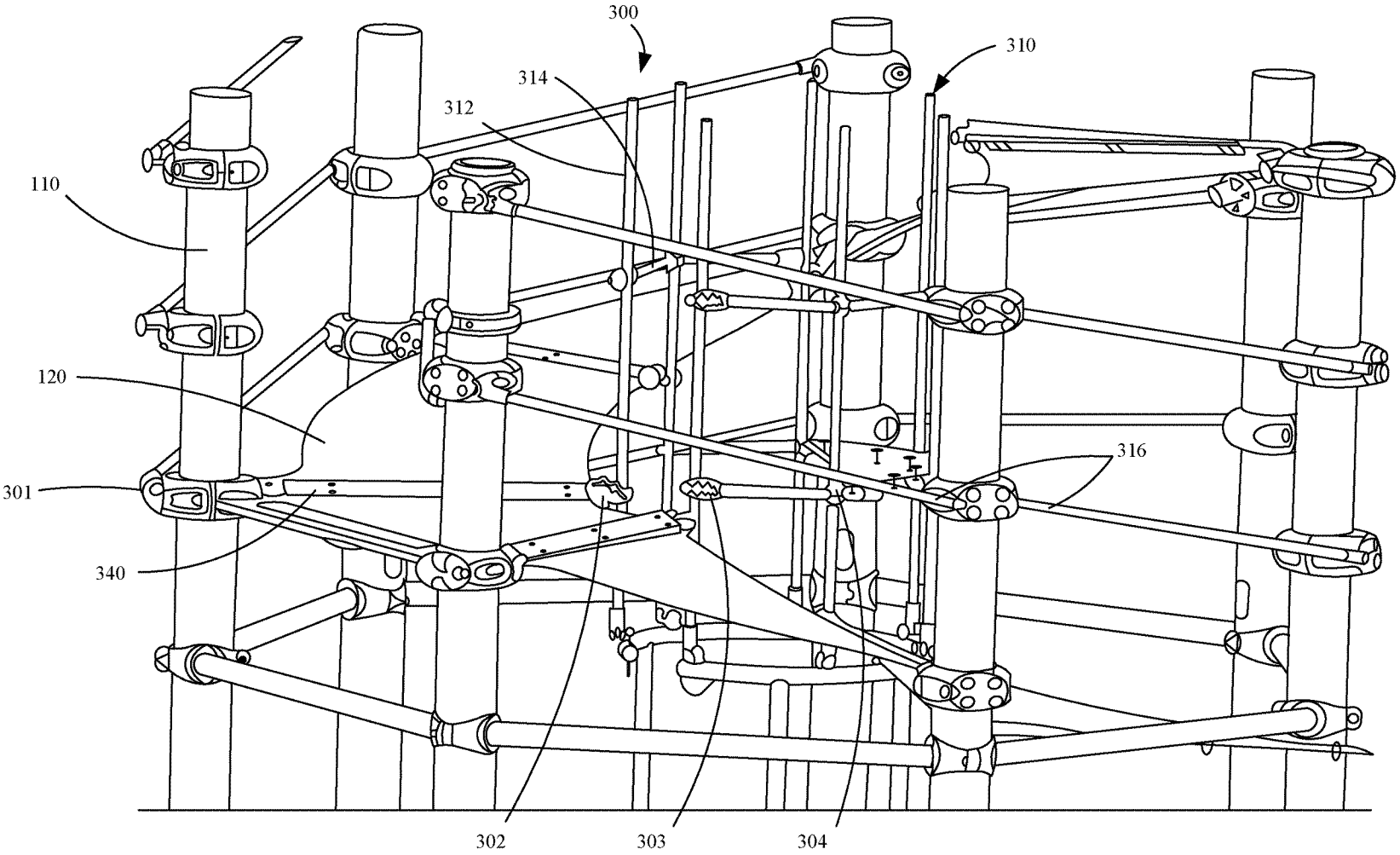
FIG. 3 is a perspective view of an example belt system.

FIG. 3 is a perspective component view of an example play system 300. Play system 300 illustratively includes support structure 110, inner support structure 310 and belt system 120. Clamp 301 couples belt system 120 to support structure 110 and rope clamp 302 couples belt system 120 to inner support structure 310. In this example, belt system 120 is clamped to the structure 110 in a way that the belt system 120 spirals or is helically arranged around inner support structure 310 in a vertical fashion to provide a way to climb the play system 300. The spiral or helical structure is for example only and could be arranged in any shape or direction such as a ramp, square or any other suitable shape.

As shown belt system 120 is coupled to clamps 302 and 301. Plate 340 reinforces this connection and can also provide rigidity to the ascending belt path surface that can be used as a handle to users but is not limited to a particular use. Belt system 120 includes flexible portions and rigid portions and plate 340 is an example of a rigid portion of the belt system 120, in other examples, rigid portions of belt system 120 can include other items.

Inner support structure 310 includes vertical ropes 312 and horizontal ropes 314. Vertical ropes 312 and horizontal ropes 314 are coupled together into a structure by T-connectors 303 and crimps 304. In other examples, different connecting means can be used to assemble the rope structure.

Additionally, ropes 316 can be provided about support structure 110. As shown, clamps 301 couple rope 316 to support structure 110. Clamp 301 may be a clamp similar to one described in U.S. Pat. No. 9,375,609. In other examples, clamps 301 can be a different type of clamp as well.

Figure 4:
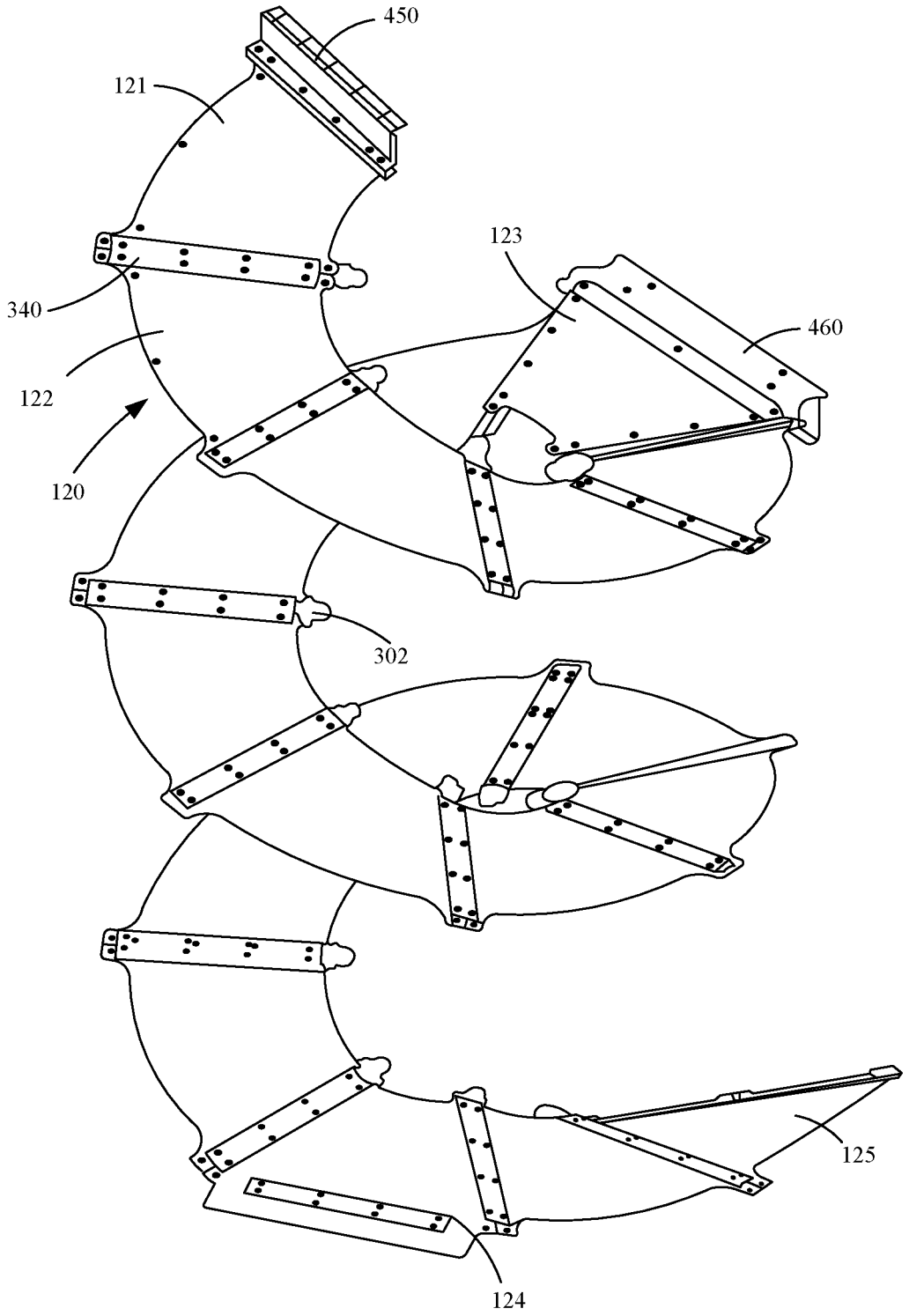
FIG. 4 is a perspective view of an example belt configuration.

FIG. 4 is a perspective-component view of an example belt configuration 400. Belt configuration 400 includes a plurality of different belts and plates. Belts in belt configuration 400 include short belt 121, long belt 122, deck belt 123, deck belt 124 and end belt 125. Short belt 121 can be utilized to adjust to a shorter rise or a different direction of a platform than long belt 122. For instance, as shown, short belt 121 is approximately half the length of long belt 122. This allows the top platform (located at transfer plate 450) to be offset from the second platform (located at deck plate 460), whereas if belt 121 were replaced with long belt 122 the top two platforms would be on the same side of belt configuration 400. Deck belts 123 and 124 can be utilized as flat sections that allow a user to get onto a platform, slide, or other component from belt configuration 400. In some examples, deck belts 123 and 124 are areas where a user can rest on a relatively flat surface.

Belt components in belt configuration 400 include a belt material that is water jet cut from a larger belt. In another example, the components may be die cut from a belt structure. In other examples, the belt component may be cut or formed in different ways. As shown, the spiral belt includes a belting material. In one example, the belting material includes rubber. In other examples, the belting material can include a material other than rubber. In some examples, the belting material can be re-enforced (e.g. Kevlar, steel, fiber, etc.) or textured. In some examples, the belting material is perforated for easier bending/folding/braiding of the components. The perforation may also provide a different experience for the user. For instance, a perforated belt may be more flexible and/or stretch.

Plates in belt configuration 400 include flat plate 340, transfer plate 450 and deck plate 460. Flat plates 340 connect various belts to one another. For example, flat plates 340 couple different belt sections together. Flat plates 340 also facilitate the coupling of belt assembly 400 to a support structure via clamps or otherwise. Transfer plate 450, as shown is used as a coupling means at the top of the play system. Transfer plate 450, in one example, is connected to a slide such that a user can easily transition to a slide. Play system 400 also includes a deck plate 460. Deck plate 460 is another coupling means to connect belt system 120 to another play structure or component of the play structure. Deck plate 460, for example, may also connect to a tunnel, a slide or a bridge or any other suitable play system component.

Plates components in belt configuration 400 include one or more coated metal (e.g., steel, aluminum, etc.) plates that are bolted together. In other examples, the plates can include a material other than metal and be formed in different ways as well. While there are benefits to plates being rigid, plates may also be semi rigid or flexible.

Figure 5:
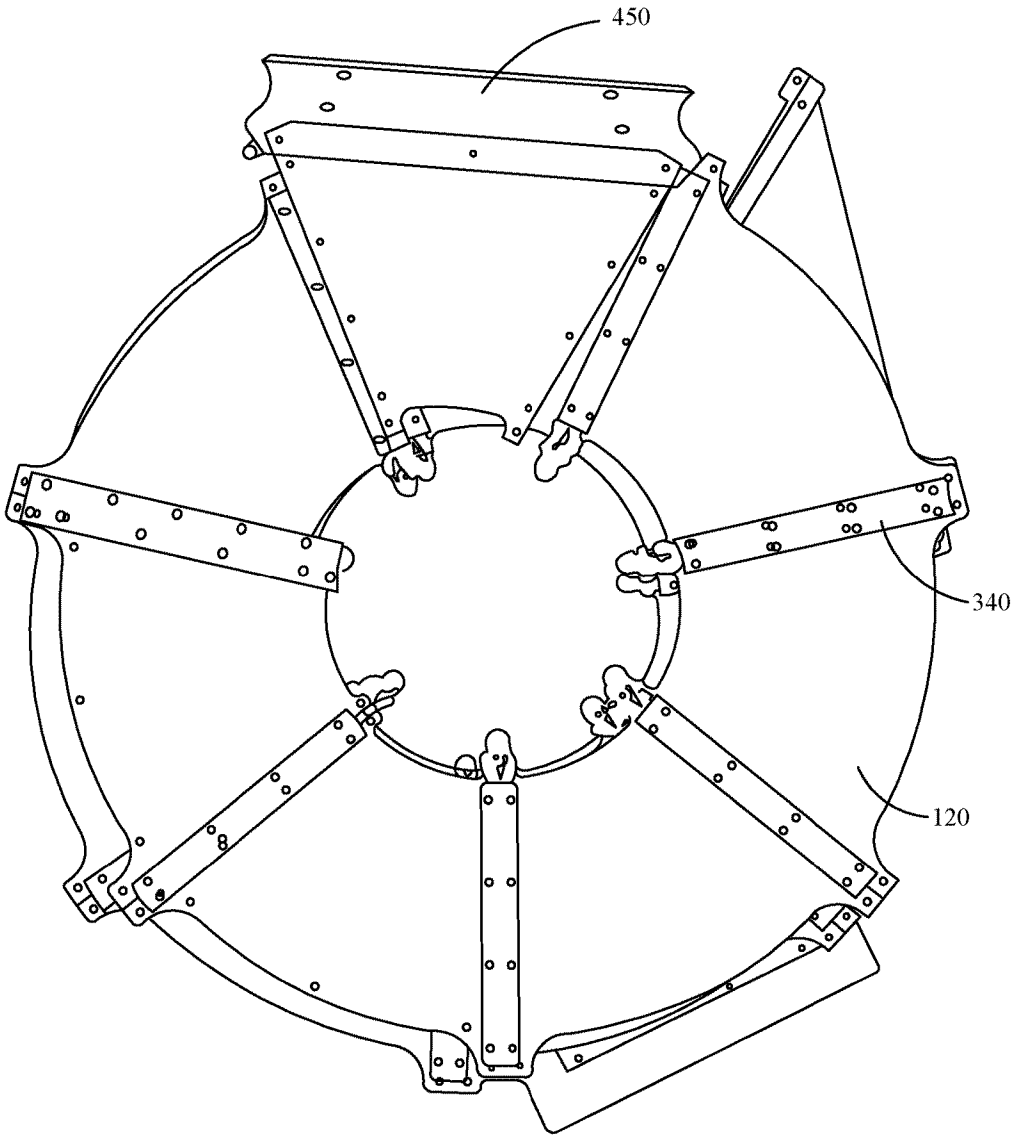
FIG. 5 is a top view of an example belt configuration.

FIG. 5 is a top view of an example belt configuration 500. FIG. 5 shows components like FIG. 4 in another view to further show how specific components are being used. As shown, belt configuration 500 is in a circular structure that forms the spiral or helical structure described above. In other examples, belt configuration may not be circular. For example, belt configuration, as viewed from the top, may be rectangular octagonal, or a different shape. In some examples, different layers of belt configuration 500 can have different shapes.

Figure 6:
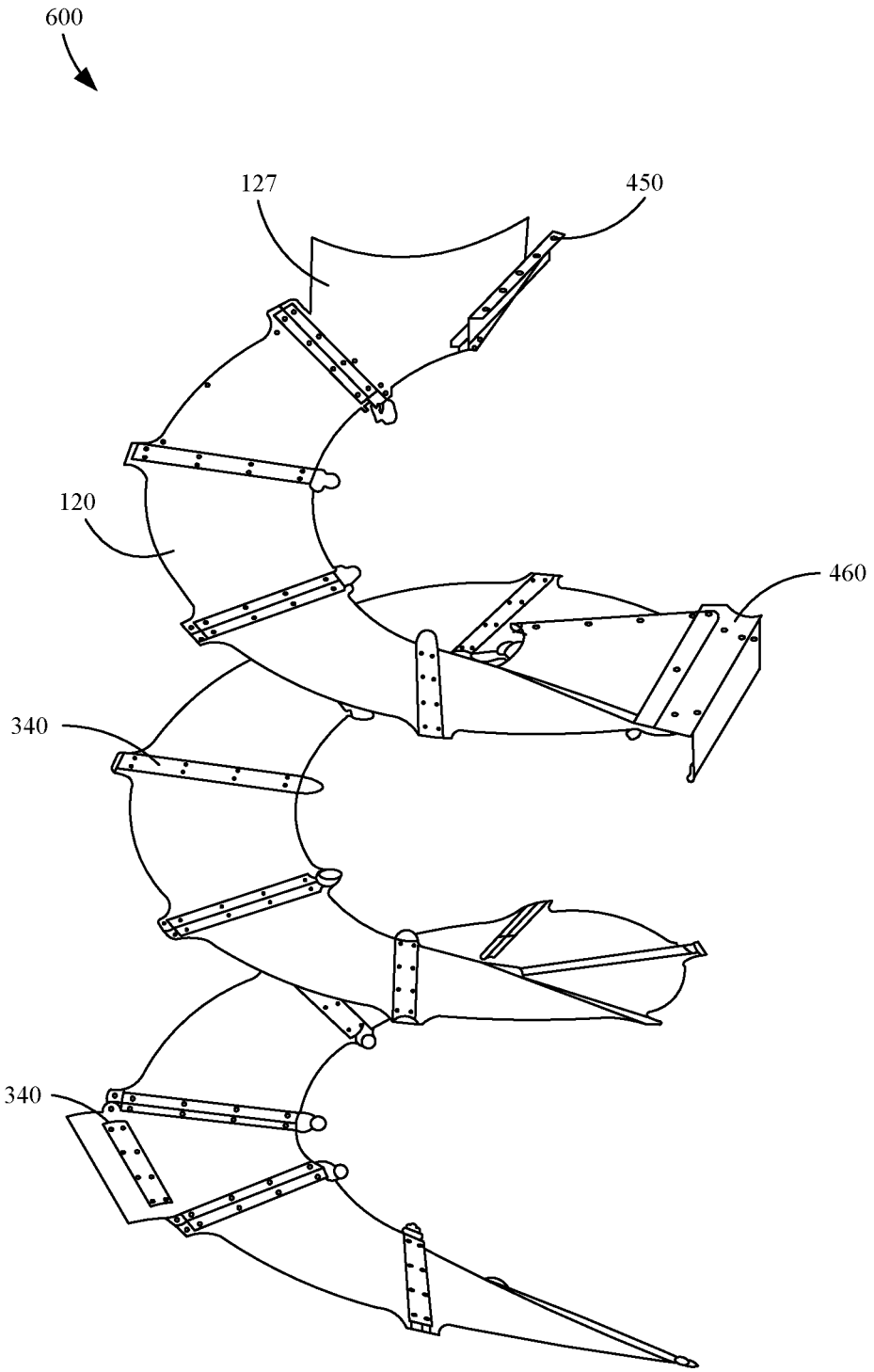
FIG. 6 is a perspective view an example belt configuration.

FIG. 6 is a perspective view an example belt configuration 600. Belt configuration 600 has some similar components as belt configuration 300. However, belt configuration 600 has a different belt component used at the top of configuration 600, belt 127. Belt 127 at the top of the play structure is particularly useful to connect to a slide or a bridge component. However, the connection mechanisms and belt components are provided for example only and are not limited to the specific shapes or uses.

Figure 7:
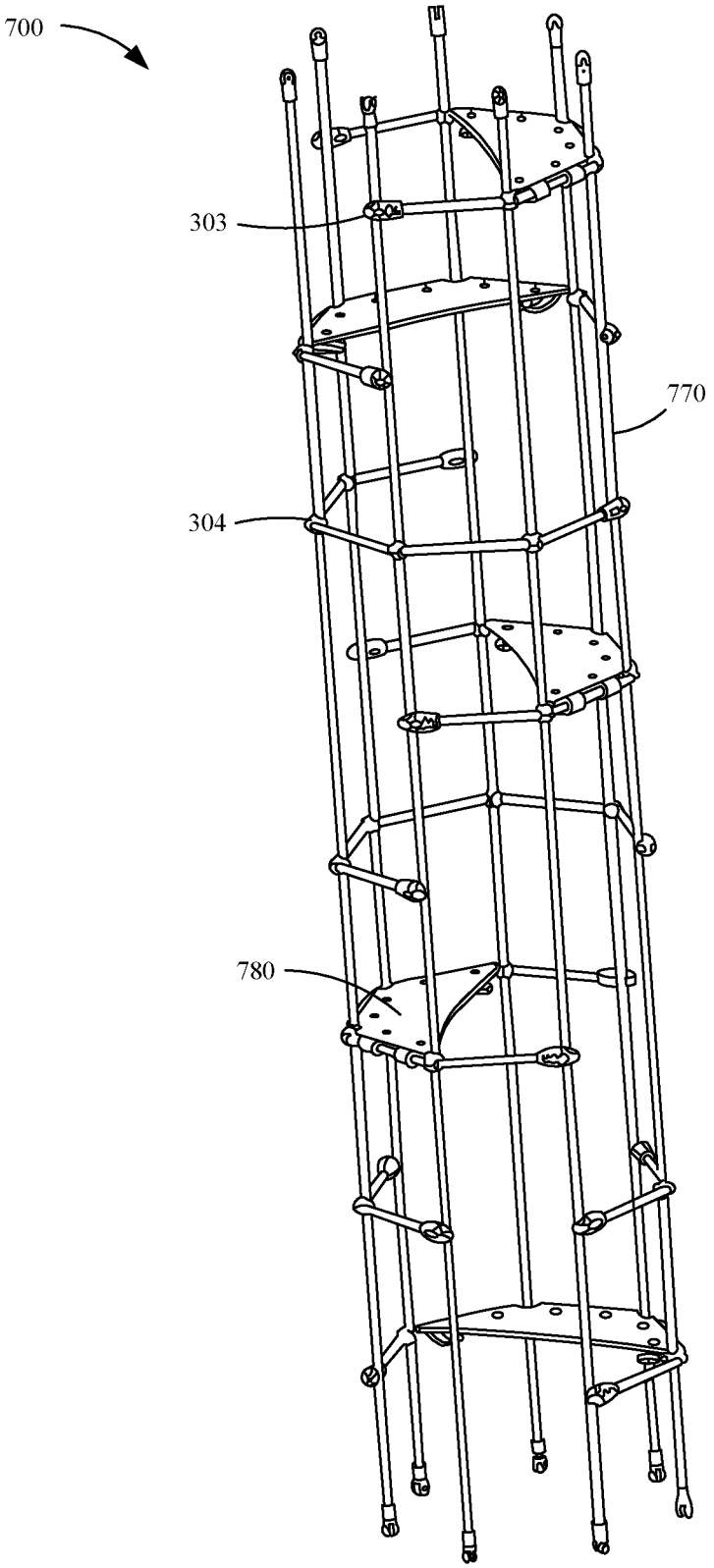
FIG. 7 is an example rope climb structure with a support belt.

FIG. 7 is an example inner support structure 700 with an internal climbing structure. FIG. 7 also provides another view connector 303 and crimp 304. Center climb assembly 700 also includes support belt 780 and rope 770. It should be noted that in this example, support belts 780 is made from the same material as belt system 120. In other examples, belts 780 include different materials. It should also be noted that rope 770 is not limited to rope and can be cable or other similar structures. Center climb assembly 700 is used as an example structure in the play system 100 and may not even be present in play system 100. Center climb assembly 700 could be like support structure 110 and not include components of the climb assembly but rather be used as an inner support structure alone. Inner support structure 700 may only include one pole or one support structure as well. It should also be noted that connector 303, crimp 304, and other coupling components may be replaced or used in conjunction with other suitable coupling means.

Figure 8:
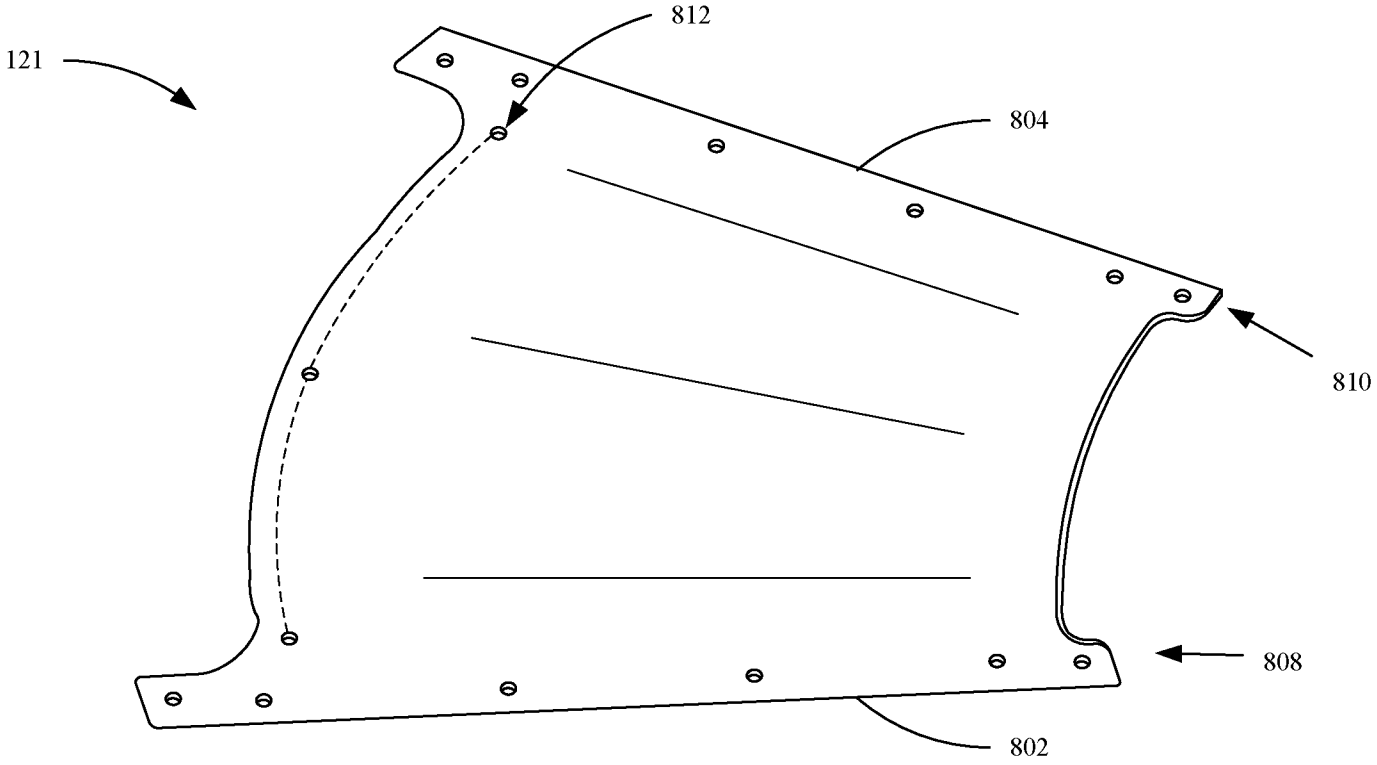
FIG. 8 is a component view of an example portion of a belt.

FIG. 8 is a component view of an example belt 121 as a portion of a belt system. Belt 121, in this example, is a short section belt that can be used in the system of belts and play structures As shown, the top edge 804 and bottom edge 802 of belt 121 form a roughly 51-degree angle and it would take roughly seven belts 121 to create a full circle. In other examples, belt 121 can be a different size. Belt 121 includes aperture sets 808, 810 and 812. Aperture sets 808 and 810 allows coupling of belt 121 to another object (e.g., another belt, an inner support structure, an outer support structure and/or plate). Aperture set 812 allows coupling of belt 121 to another object (e.g., an inner support structure, an outer support structure, etc.). In other examples, aperture sets can be replaced by other coupling mechanisms (e.g., belt clamps that may or may not require apertures in the belt).

Figure 9:
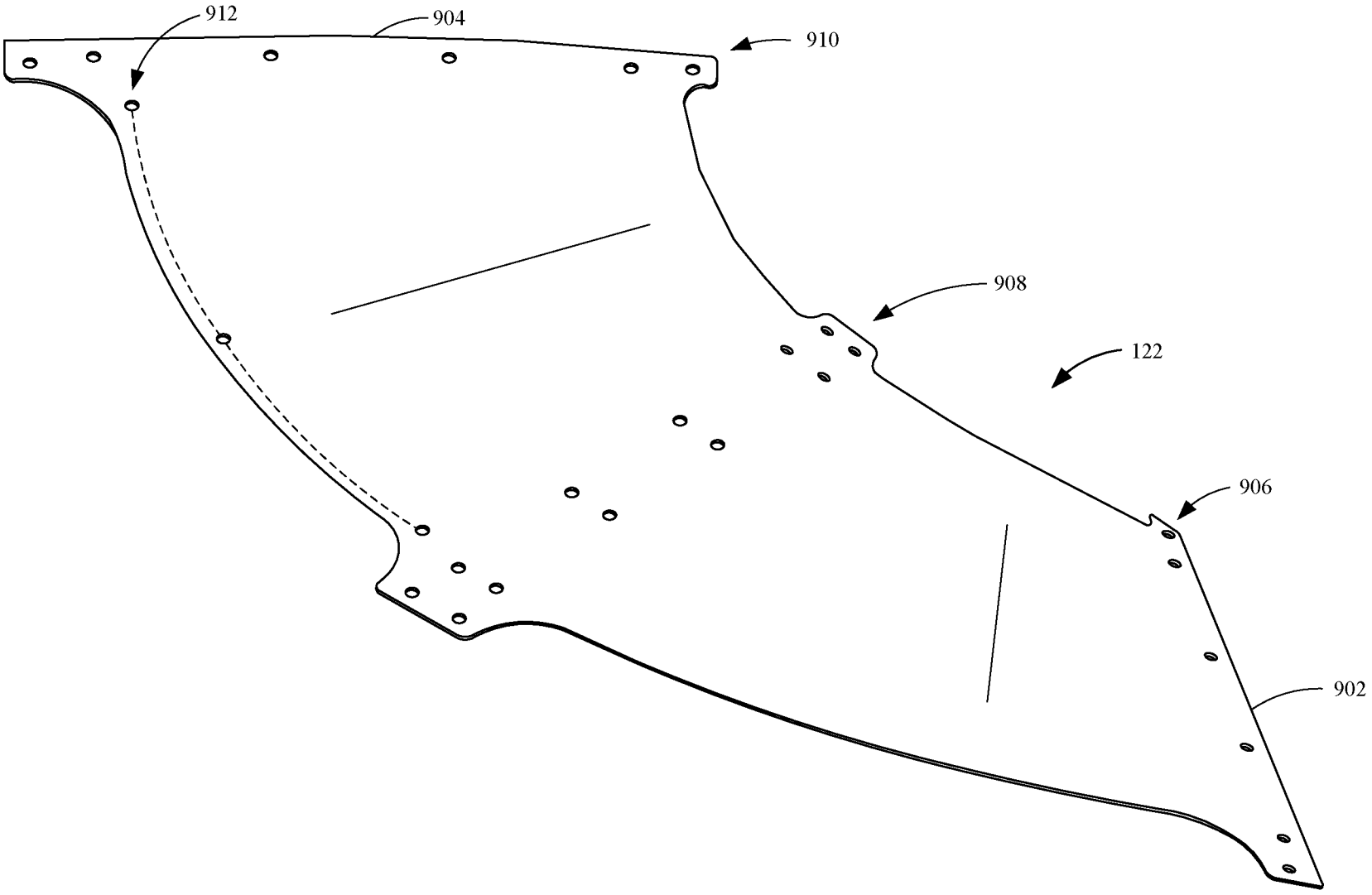
FIG. 9 is a component view of an example portion of a belt.

FIG. 9 is a component view of an example belt 122 as a portion of a belt system. Belt 122 is a long-section belt. A two-section belt is used in the main portion of the belt where, in this example, the belt is spiraling around the support structure and no additional component (such as slides or bridges) need to be attached to that section. As shown, the top edge 904 and bottom edge 902 of belt 122 form a roughly 102-degree angle and it would take roughly three and a half belts 122 to create a full circle. In other examples, belt 122 can be a different size. Belt 122 includes aperture sets 906, 908, 910 and 912. Aperture sets 906 and 910 allows coupling of belt 122 to another object (e.g., another belt, an inner support structure, an outer support structure and/or plate). Aperture set 908 allows coupling of belt 122 to another object (e.g., an inner support structure, an outer support structure, etc.) Aperture sets 906, 908 and 910 also allow a rigid component (e.g., a plate) to couple to belt 122 and provide some rigidity to belt 122. Greater or fewer numbers of aperture sets can be provided to increase or decrease rigidity.

Figure 10:
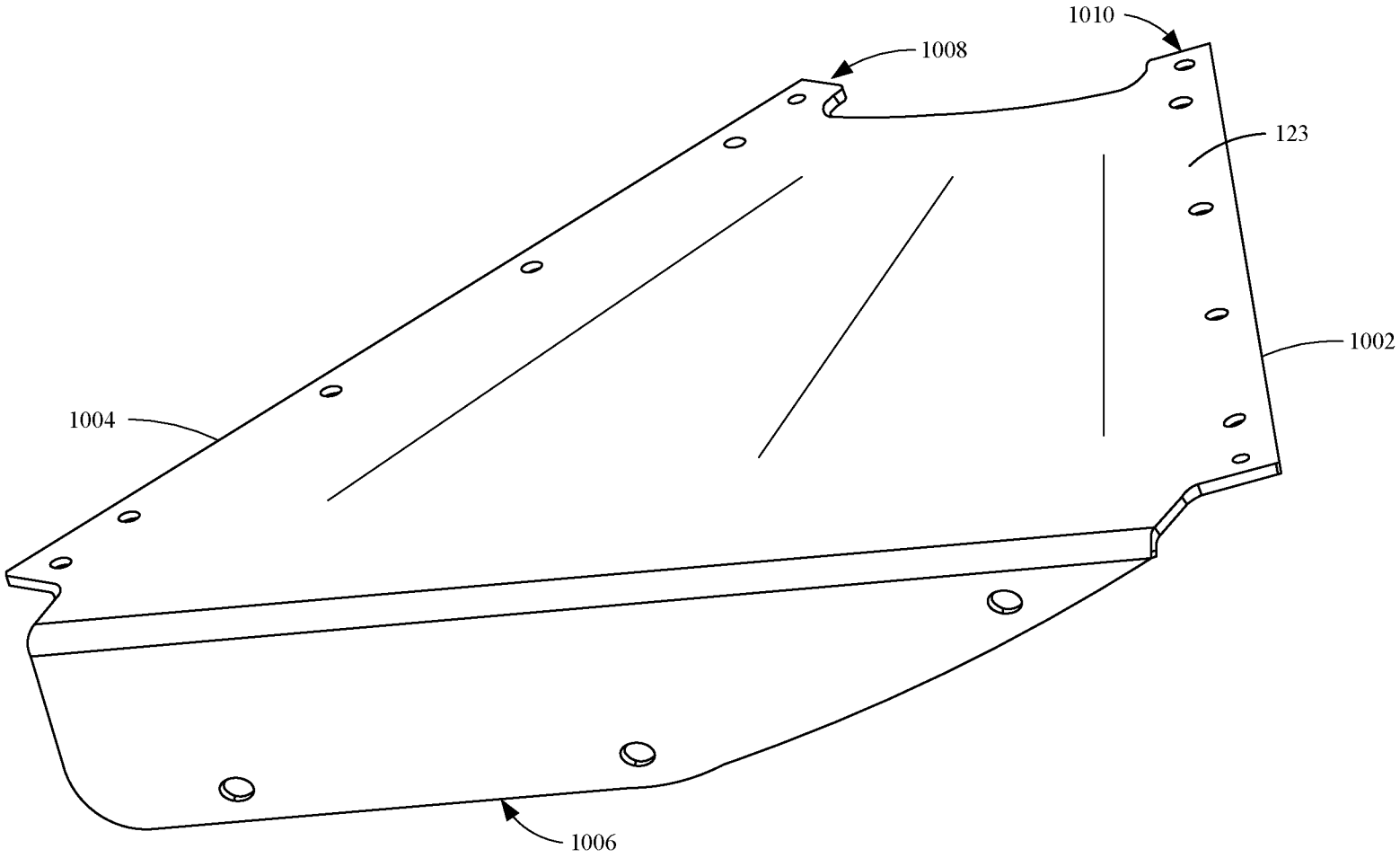
FIG. 10 is a component view of an example portion of a belt.

FIG. 10 is a component view of an example belt 123 as a portion of a belt system. Belt 123 includes edges 1002 and 1004. Edges 1002 and 1004 are where belt 123 is coupled to another belt or object. Edge 1002 includes set of apertures 1010 and edge 1004 includes set of apertures 1008. That allow coupling of a plate or other object to belt 123. Belt 123 also includes a component fastening portion 1006. Component fastening portion 1006 allows belt 123 to couple to an object such as a slide, platform, tunnel, etc.

Figure 11:
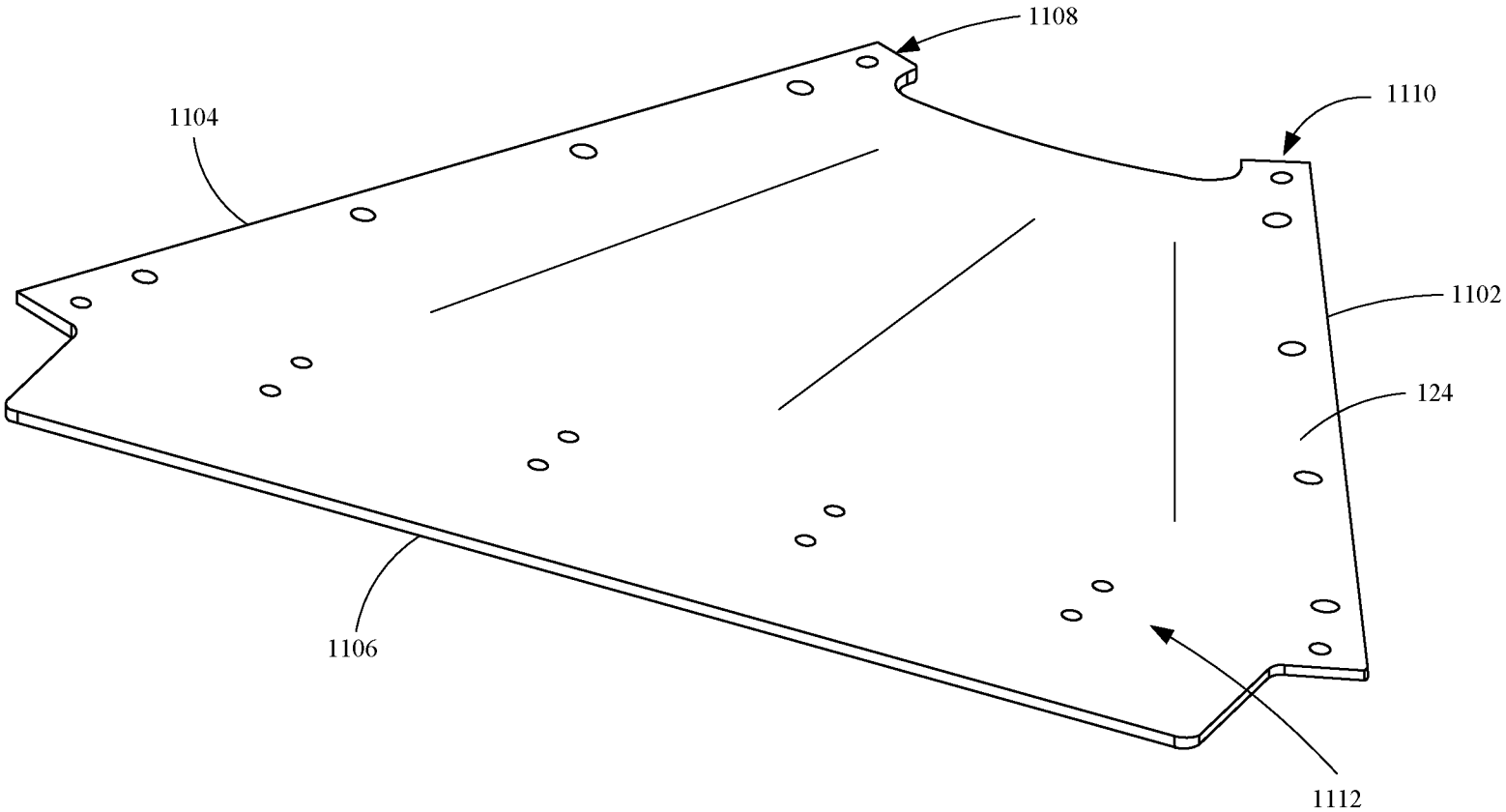
FIG. 11 is a component view of an example portion of a belt.

FIG. 11 is a component view of an example belt 124 as a portion of a belt system. Belt 124 is a slide connector belt. Belt 124 includes edges 1102 and 1104 that have aperture sets 1108 and 1110 which allow belt 124 to couple to other belt sections or objects. Edge 1106 includes set of apertures 1112 which allow coupling of belt 124 to another object (e.g., a slide, platform, tunnel, etc.).

Figure 12:
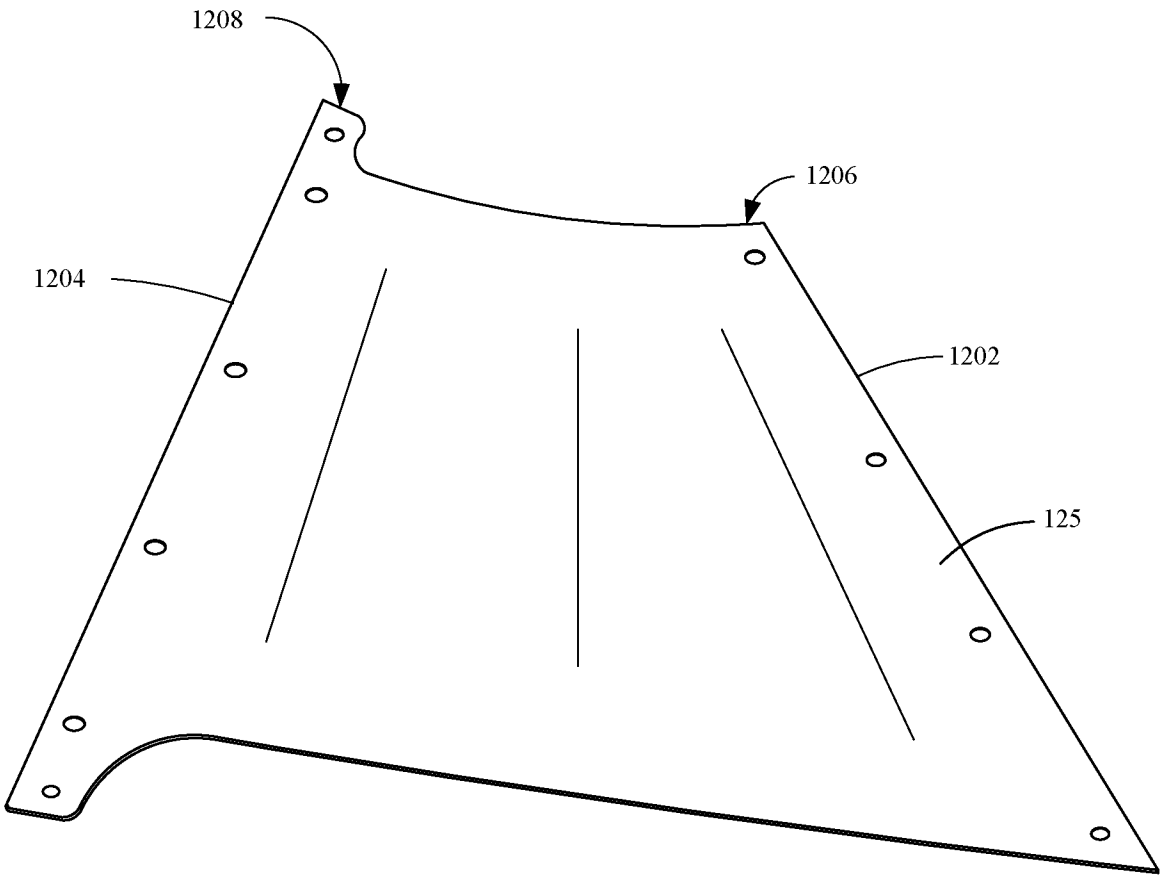
FIG. 12 is a component view of an example portion of a belt.

FIG. 12 is a component view of an example belt 125 as a portion of a belt. Belt 125 is a base belt piece. It should be noted that this belt component does not have to be at the base of the play structure but is useful to connect to the ground, a bottom piece or a ramp or other suitable connections to be used at the bottom of the support structure. Belt 125 includes bottom edge 1202 and top edge 1204. Bottom edge 1202 is angled such that it can contact the ground or another flat surface. Bottom edge 1202 includes set of apertures 1206 that can receive fasteners to secure bottom edge 1202 to a surface. For example, a plate on the ground. Top edge 1208 includes set of apertures 1208 that allow top edge 1204 of belt 125 to coupled to another belt section or other object.

Figure 13:
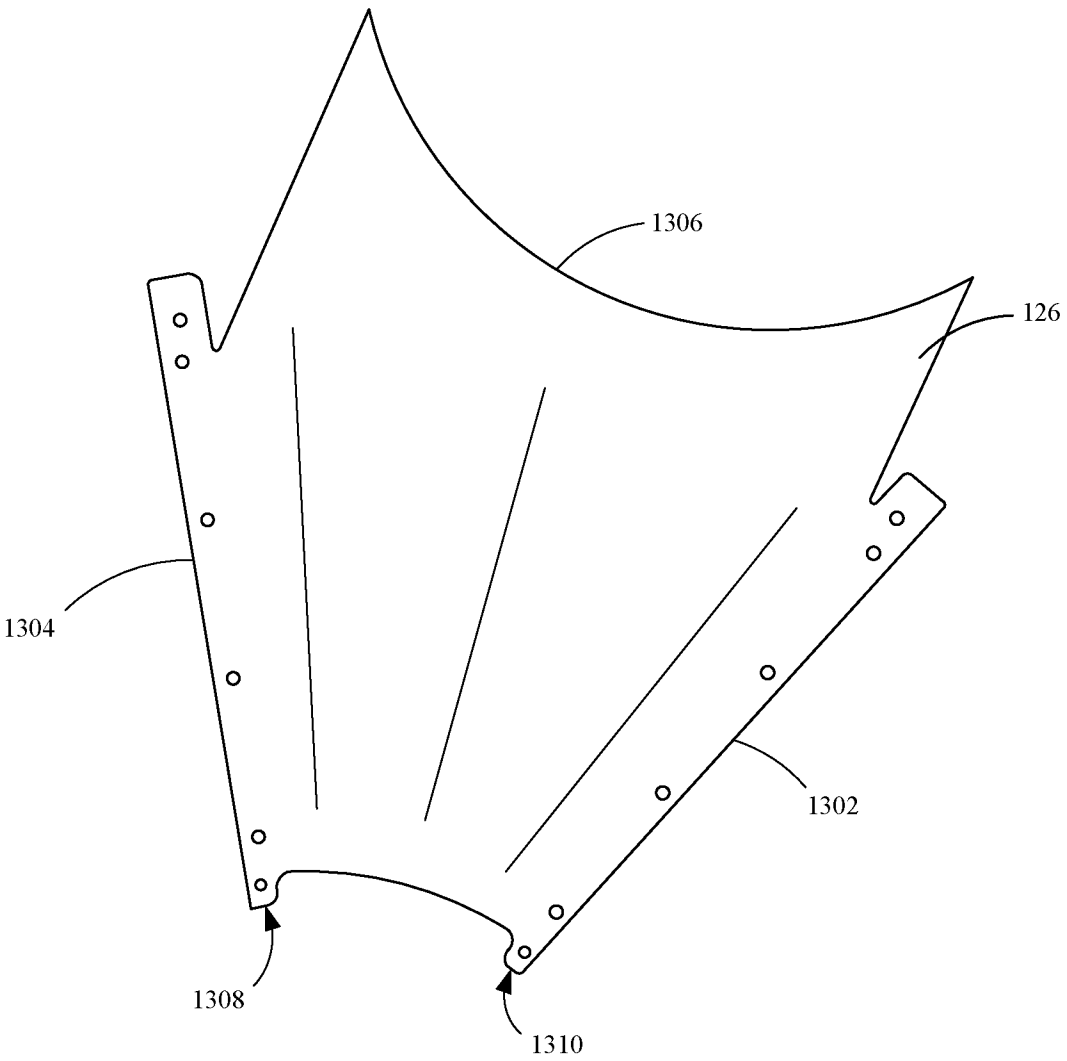
FIG. 13 is a component view of an example portion of a belt.

FIG. 13 is a component view of an example belt 126 as a portion of a belt system. Belt 126 as shown is a tunnel belt system. This component of the belt 126 is particularly useful for connecting to a tunnel or other structure of a play structure. The shape and structure allows for an easy connection and transfer to a tunnel/bridge. It should be noted that belt 126 does not have to connect to a bridge, but it is provided as an example.

Figure 14A:
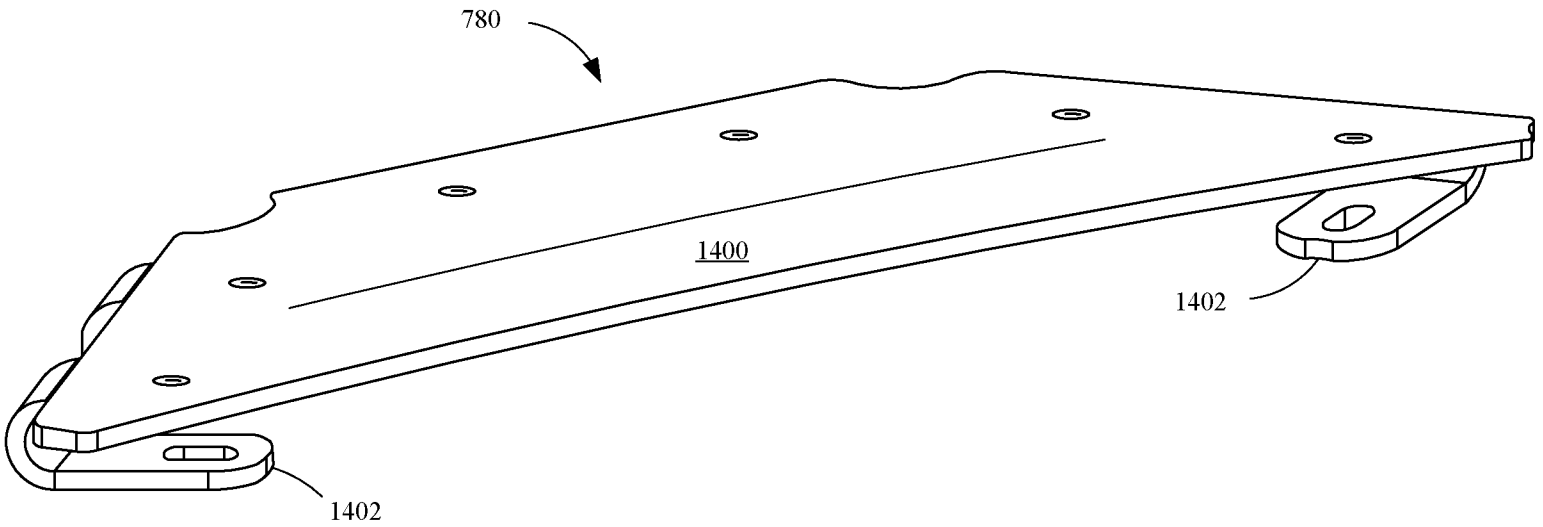
FIGS. 14A and 14B are component views of a support belt.
Figure 14B:
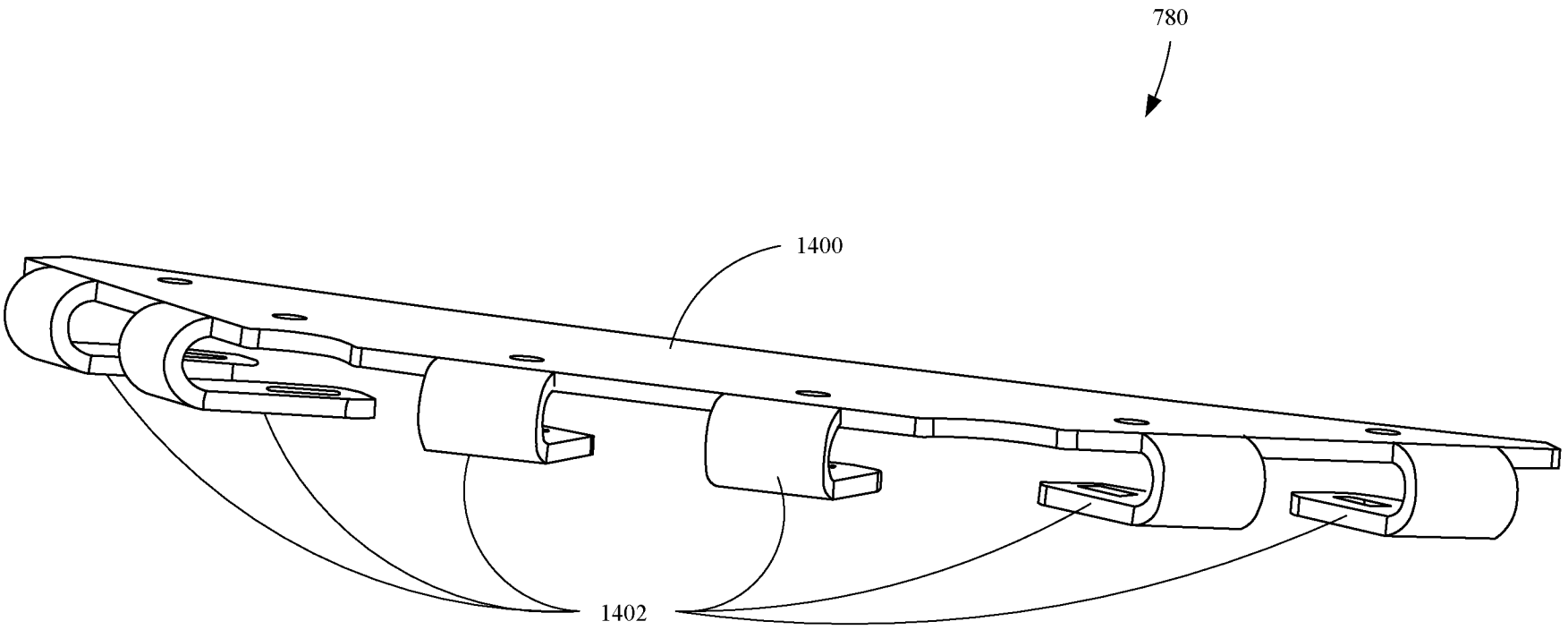

FIGS. 14A and 14B are component views of a support belt 780. FIGS. 14A and 14B are different views of the climb support belt 780. Belt 780 includes a platform surface 1400 and fastener mechanisms 1402. Fastener mechanisms 1420 allows belt 780 to couple to a structure (e.g., a rope or pole structure). As shown, faster mechanisms 1402 include flaps and apertures that allow for coupling. However, in other examples, fastener mechanisms 1402 can include other items as well. It can be seen in FIG. 7 that these climb support belts are arranged vertically inside the inner support structure to provide an additional means of adventuring up and down the play system 100. These climb support belts 780 are provided as an additional example means of climbing the play system and should not be limiting. In some examples, support belts 780 are not needed and a user merely climbs the ropes.

Figure 15:
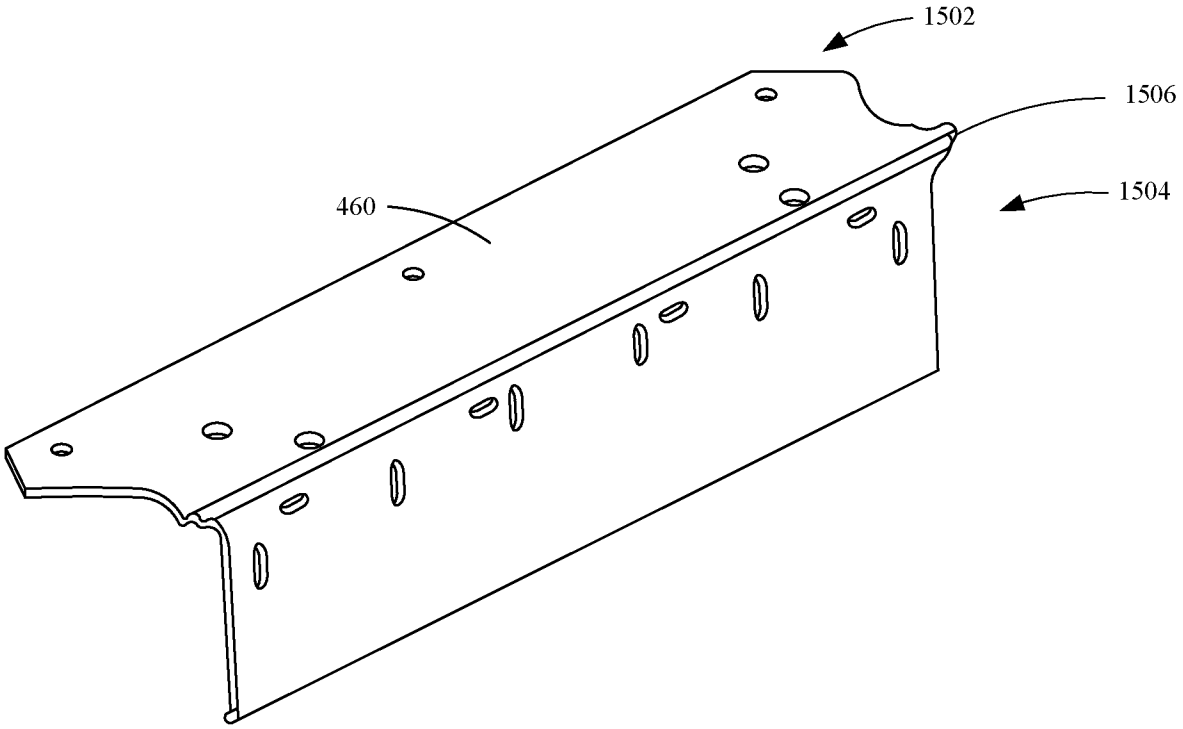
FIG. 15 is a component view of an example deck plate.

FIG. 15 is a component view of an example deck plate 460. Deck plate 460 is particularly useful for connecting to additional components of the play system 100. Plate 460 includes fold 1506 that separates top portion 1502 and bottom portion 1504. Top portion includes set of apertures that allow for plate 460 coupled to an item (e.g., a deck, slide, platform, tunnel, etc.). And bottom portion 1504 includes a set of apertures allow plate 460 coupled to an item (e.g., a belt). Deck plate 460, in one example, may connect to a bridge component or a slide. Deck plate 460, in another example, may just connect to the support structure 110. In another example, deck plate 460 may not be connected to any other item, but rather, is an end of the belt surface.

Figure 16:
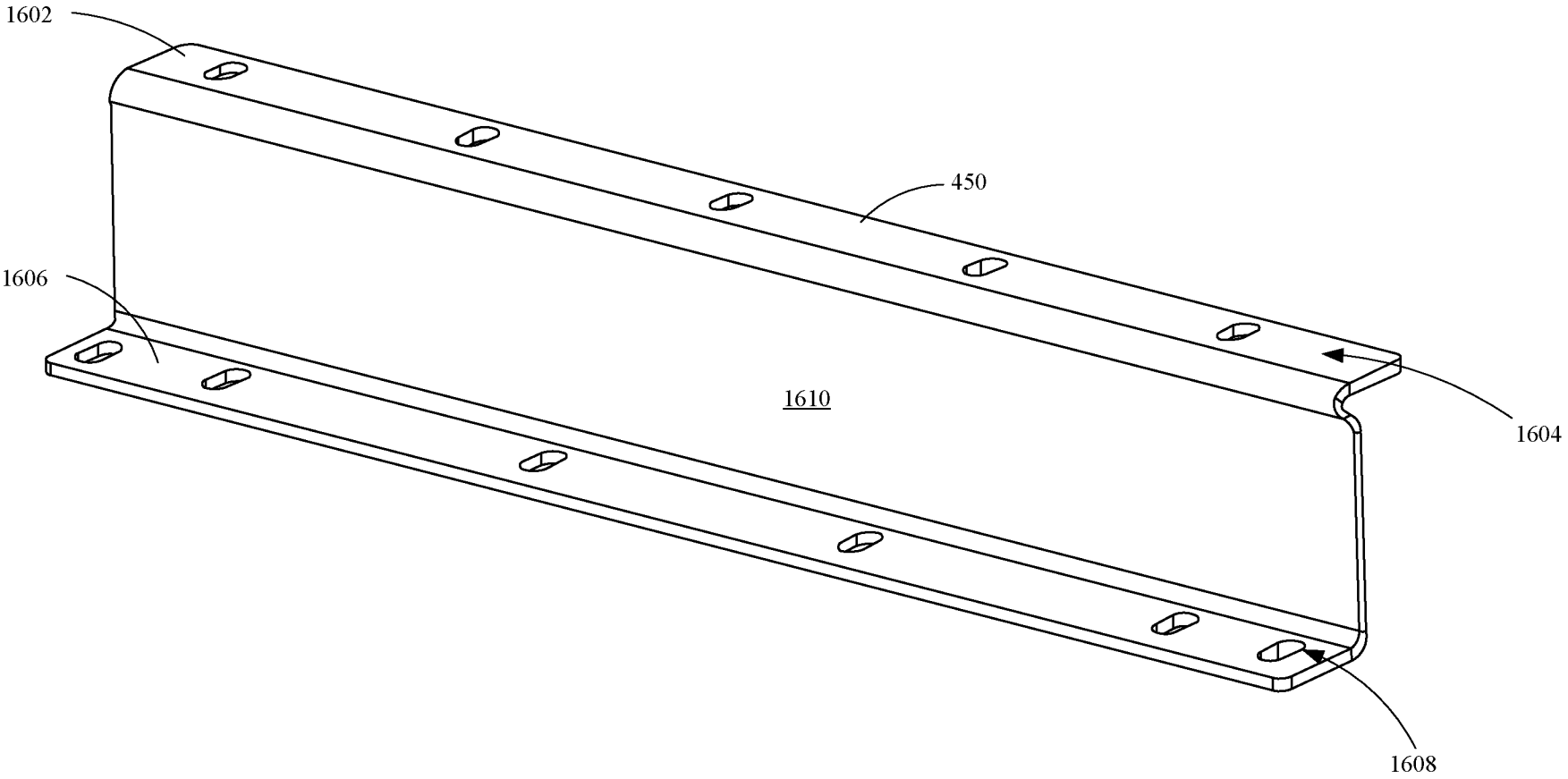
FIG. 16 is a component view of an example transfer plate.

FIG. 16 is a component view of an example transfer plate 450. Transfer plate 450 can be similar to deck plate 460 in that it is used as a coupling mechanism to additional components of the play structure. Transfer plate 450 is shaped in a different fashion such as to connect to the support structure or to a slide or to a belting component in a different fashion. Plate 450 includes a top flange 1602 which includes a plurality of apertures 1604 that allow plate 450 to couple to an object (e.g., a platform). Plate 450 also includes a bottom flange 6006 which includes a plurality of apertures 1608 which allow plate 450 to couple to another object (e.g., a belt). Plate 450 also includes riser 1610 which couples flange 1602 and 1606 together at an offset height. Transfer plate 450 is particularly useful at the top of the support structure when connecting to the roof or an additional structure for an end connection.

Figure 17A:
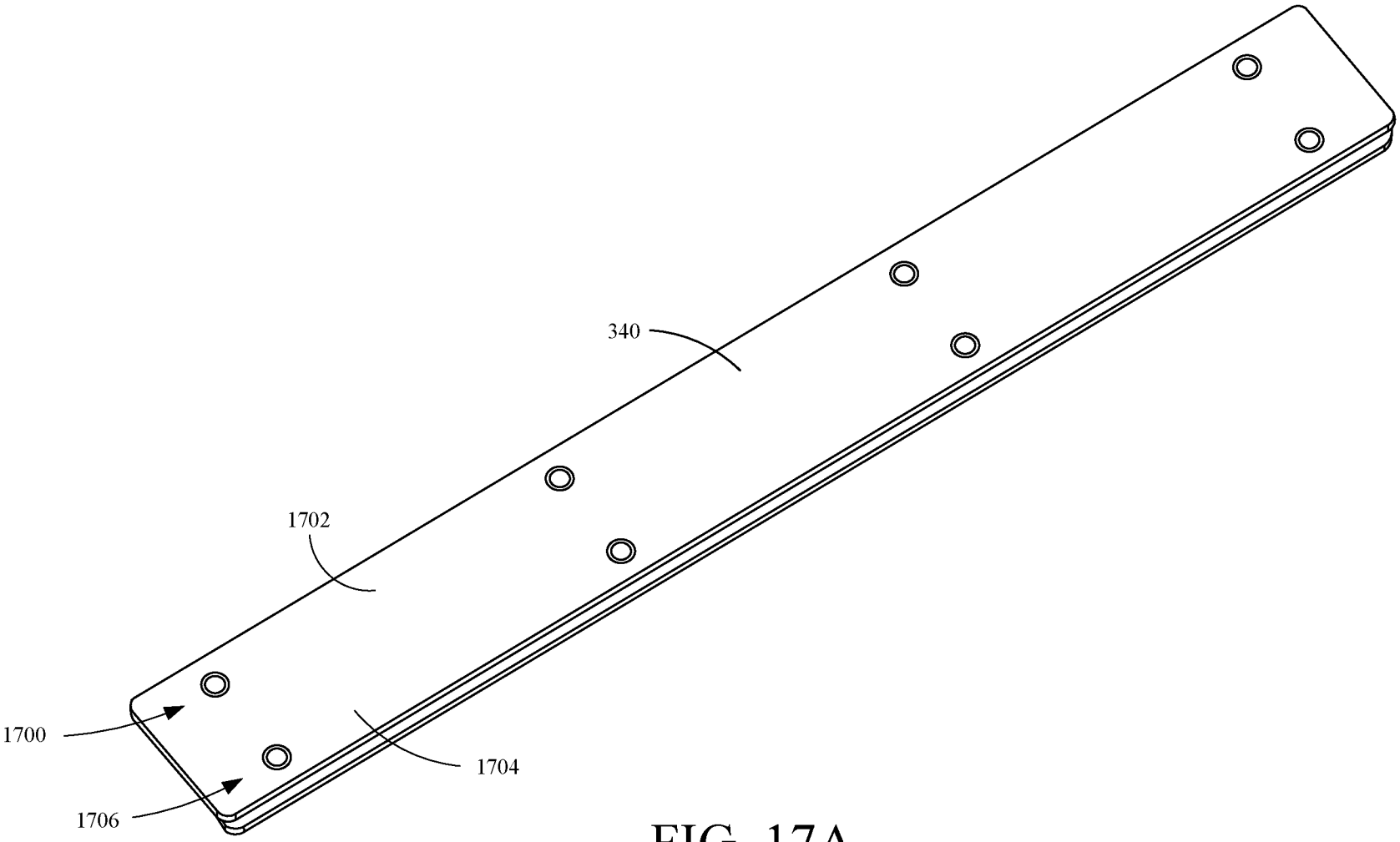
FIGS. 17A-17C are component views of an example plate.
Figure 17B:
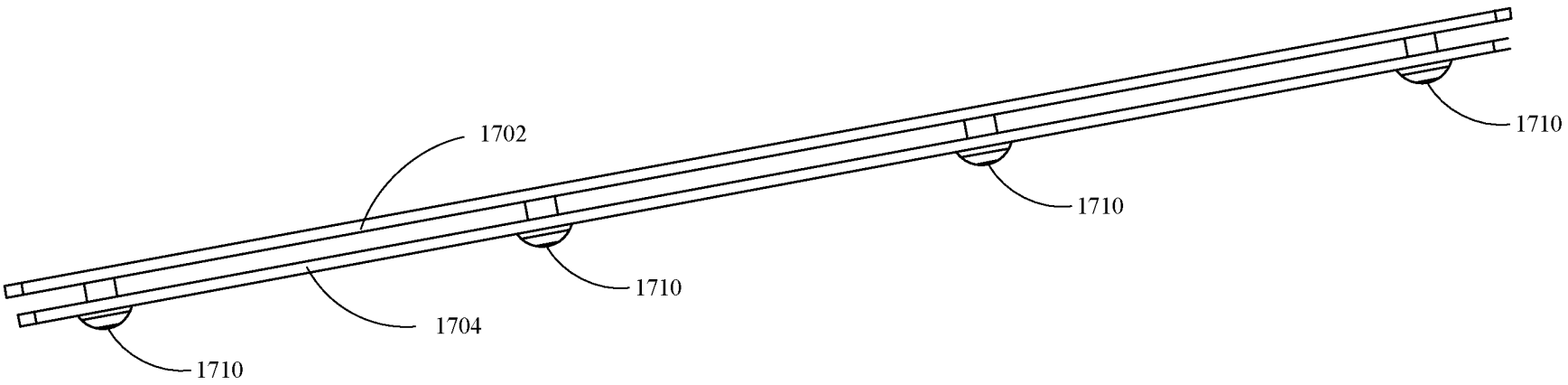
Figure 17C:
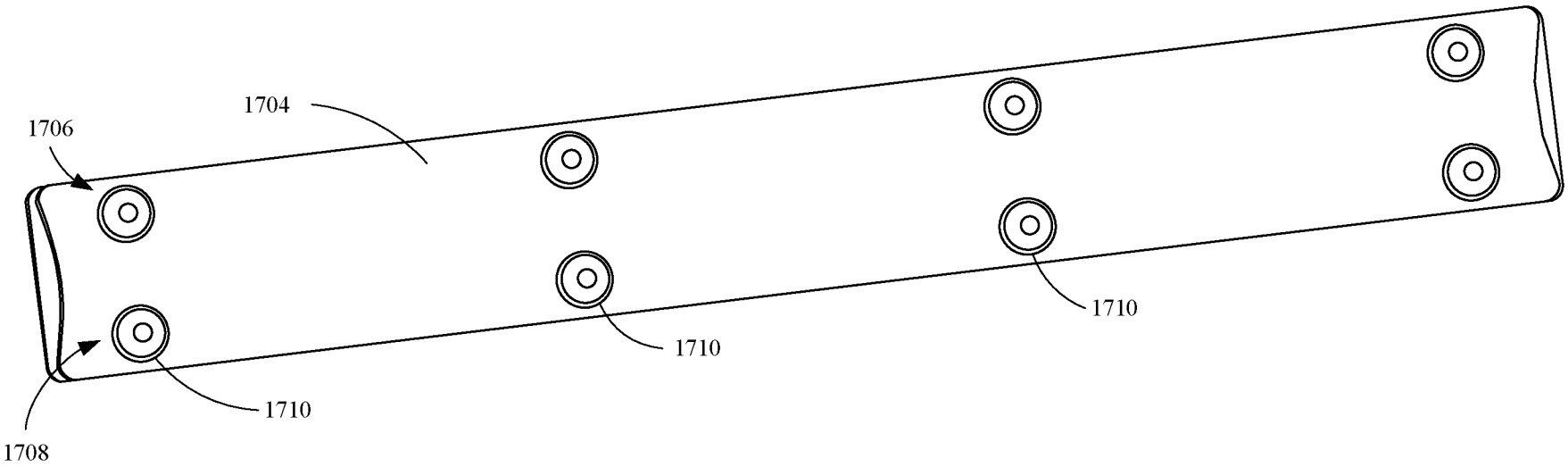

FIGS. 17A-17C are component views of an example plate 30. Plate 340 includes a top plate 1702 and a bottom plate 1704 which are coupled together by fasteners 1710 in sets of apertures 1706 and 1708. Fasteners 1710 also can allow plate 340 to couple to other objects. For example, plate 340 may also be coupled to be inner support structure or the inner climb assembly of play system 100. In one example, fasteners in aperture set 1706 couples to one belt and fasteners 1710 in aperture set 1708 couples to another belt. In some examples, there is only one plate 1702 and fasteners 1710 couple plate 1702 or 1704 directly to an object.

Plate 340 can also be used by a user on belt system 120 to assist in climbing play system 100. Plate 340 can include any semi-rigid material to provide rigidness or support to belt system 120.

Figure 18A:
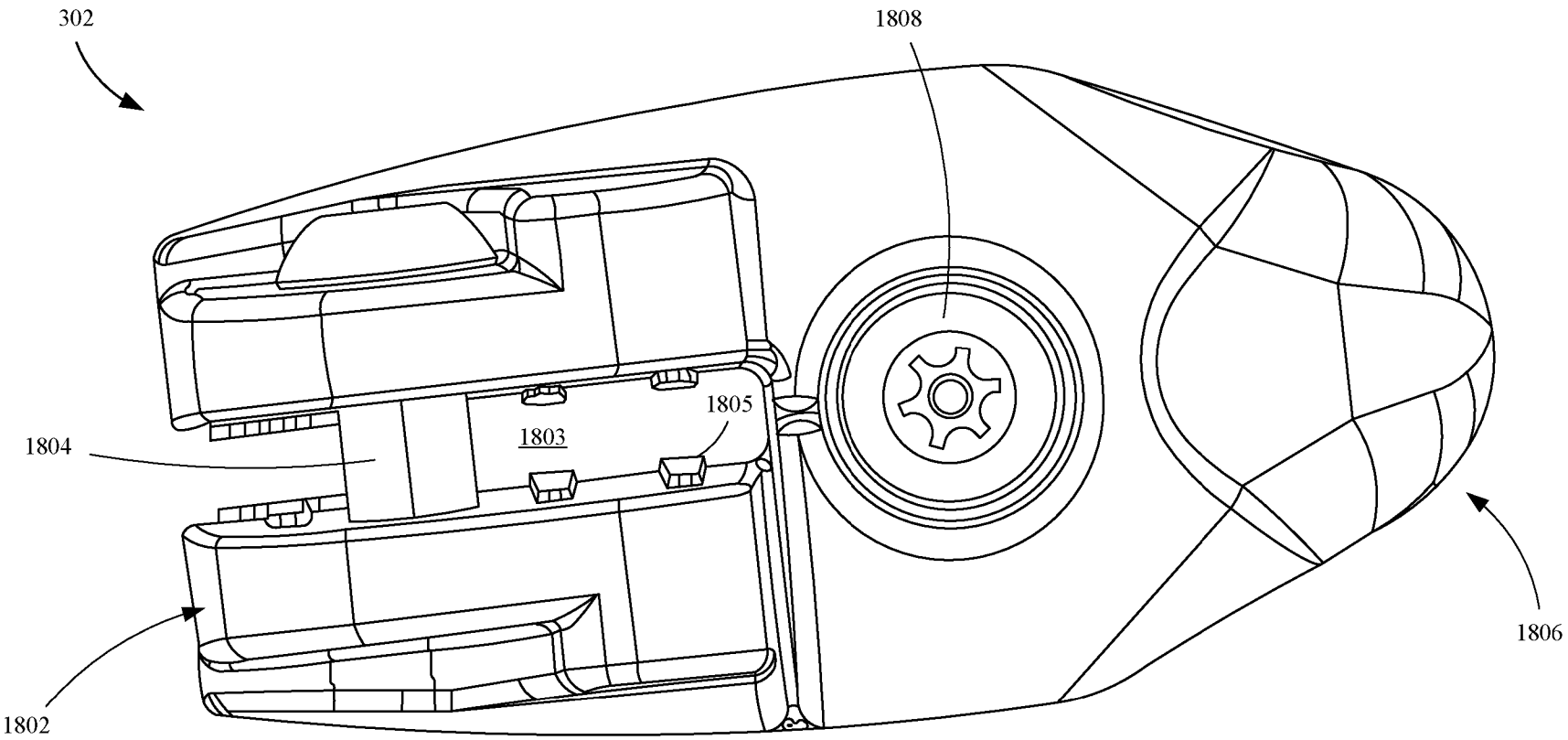
FIGS. 18A and 18B are component views of an example clamp.
Figure 18B:
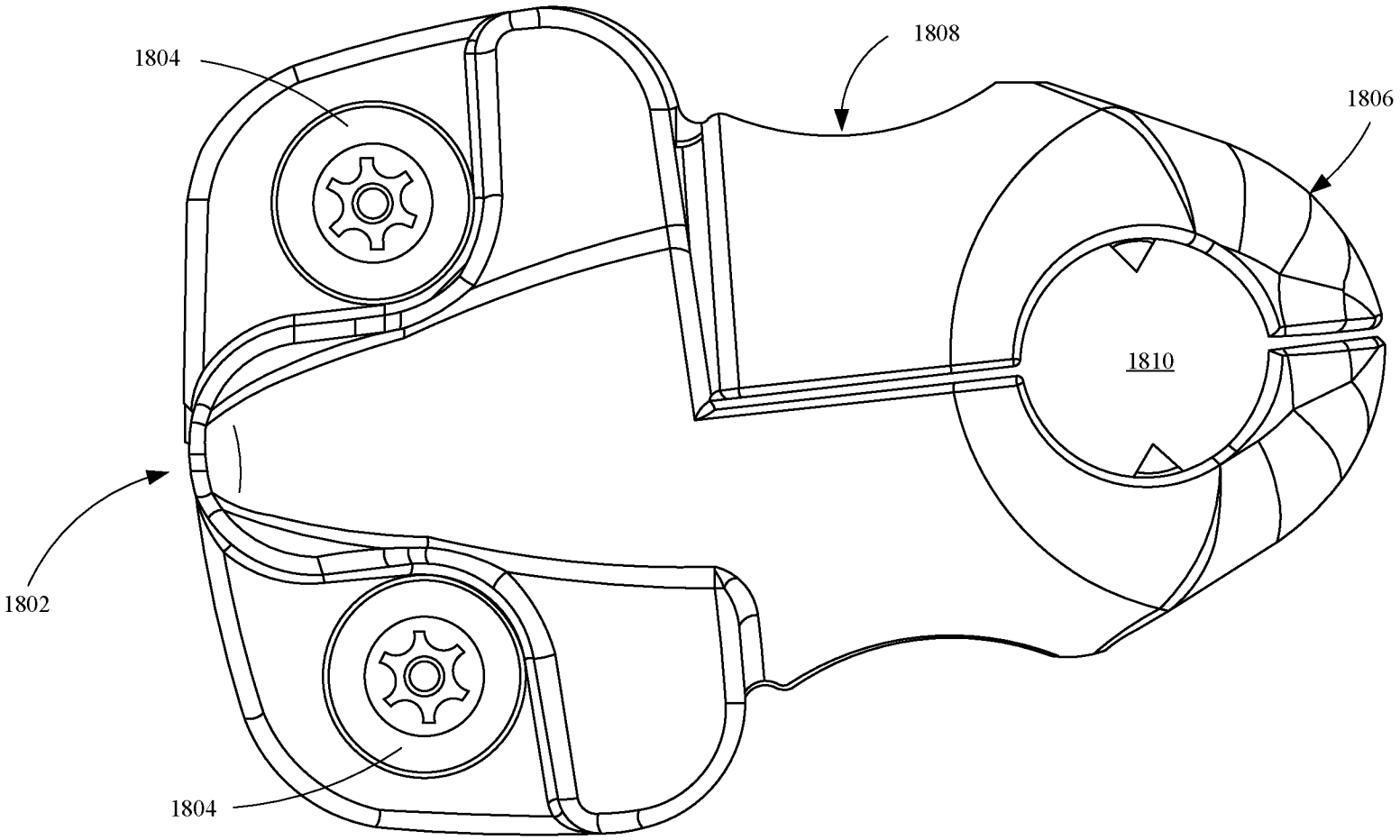

FIGS. 18A and 18B are component views of an example clamp 302. Clamp 302 facilitates a coupling between a belt/flat object to a rope/cable. Clamp 302 includes a belt coupling end 1802 and a rope coupling end 1806. Belt coupling end 1802 includes clamping area 1803 which receives the belt. An operator can then tighten fastener 1804 to tighten clamping area 1803 on the belt. In this example, the belt needs an aperture to receive fastener 1804. In other examples, the clamping force alone is enough to safely retain the belt. Clamping area 1803 can include clamping features 1805 that increase friction on the belt when fastener 1804 is tightened.

Rope coupling end 1806 includes rope receiving area 1810 and fastener 1808. Rope receiving area 1810 receives the rope and fastener 1808 tightens receiving area 1810 to lock clamp 302 onto the rope. As shown, belt coupling end 1802 and rope coupling end 1806 are rotated 90 degrees apart from one another. In another example, the ends are rotated at a different angle from one another.

Figure 19:
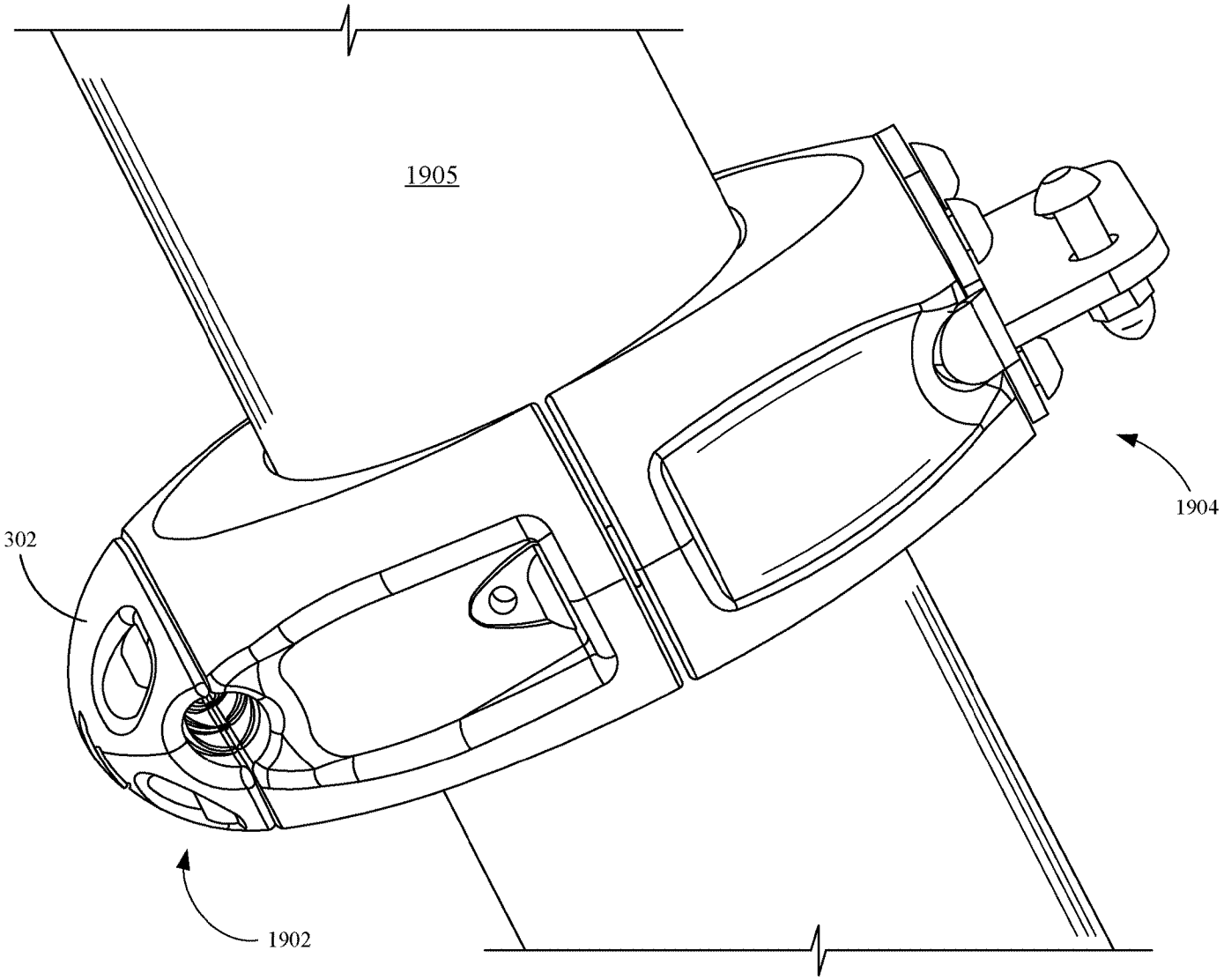
FIG. 19 is a component view of an example clamp.

FIG. 19 is a component view of an example clamp 301. In this example, support structure 110 is a post or other suitable support structure 100. Clamp 301 has a rope coupling end 1902 and a plate/belt coupling end 1904. In some examples, rope coupling end 1902 and a plate/belt coupling end 1904 are interchangeable. For instance, both ends could include rope coupling ends 1902 or plate/belt coupling ends 1904. As shown, plate/belt coupling end 1904 receives the belt at an angle perpendicular to post 1905. In other examples, plate/belt coupling end 1904 is angled to match the ascension angle of the belt path.

Figure 20:
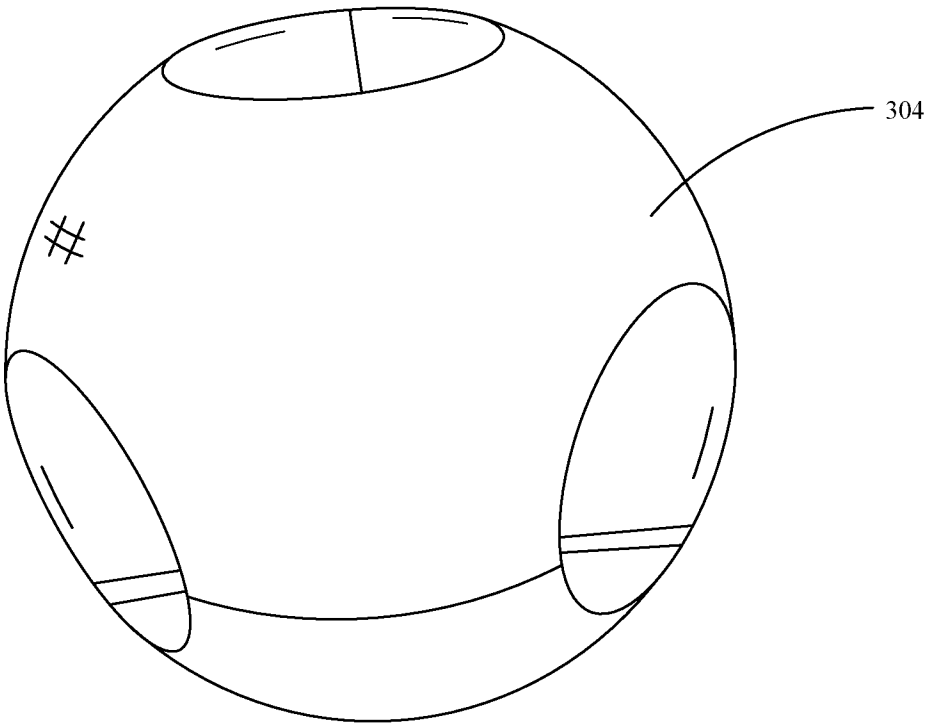
FIG. 20 is a component view of an example crimp.

FIG. 20 is a component view of an example crimp. Crimp 304 is used in inner climb assembly 700 as a coupling mechanism for the climb assembly. In this example, crimp 304 is coupled to an assembly of ropes that are connected in a fashion shown in FIG. 7. For example, crimp 304 couples perpendicular ropes together.

Figure 21:
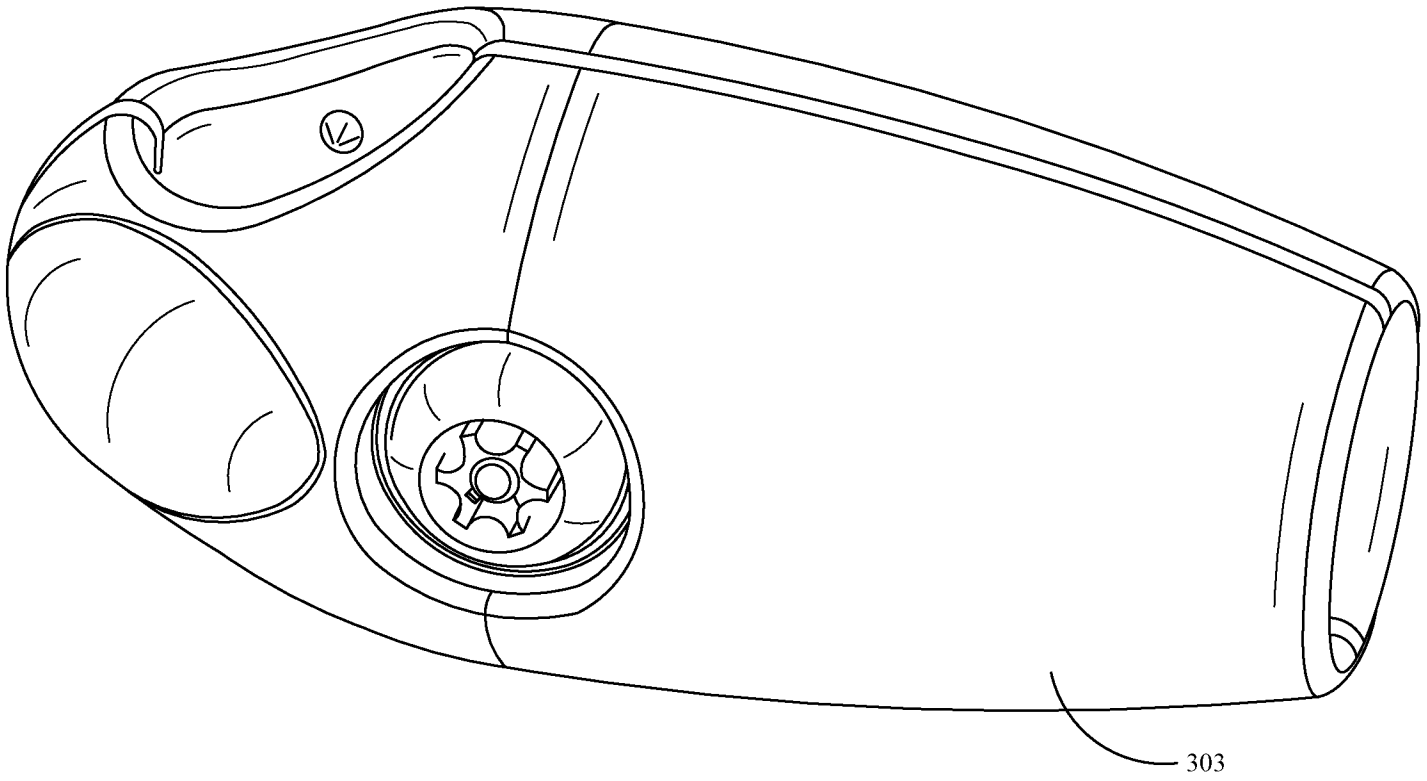
FIG. 21 is a component view of an example connector.

FIG. 21 is a component view of an example connector. Connector 303 is used in this example as a means of connecting a vertical rope to a horizontal rope such is that in a T-fashion.

Although the present invention has been described with reference to preferred embodiments, workers skilled in the art will recognize that changes may be made in form and detail without departing from the spirit and scope of the invention.

What is claimed:

1. A play system comprising:

a support structure, having a bottom end and a top end, vertically oriented relative to a surface such that the bottom end contacts the surface and the top end is above the surface;

a belt assembly having flexible portions and rigid portions that forms an ascending surface inside of the support structure such that it ascends from the bottom end of the support structure to the top end of the support structure, the ascending surface configured to allow users to ascend and descend on;

wherein the rigid portions each comprise a plate; and a plurality of clamps that couple the support structure and the belt.

2. The play system of claim 1, wherein the support structure comprising a plurality of poles.

3. The play system of claim 1, further comprising:

an inner support structure; and a second plurality of clamps that couple the inner support structure to the belt.

4. The play system of claim 3, wherein the inner support structure comprises a rope structure.

5. The play system of claim 4, wherein the inner support structure comprises a plurality of climbing platforms.

6. The play system of claim 1, wherein each of the flexible portions of the belt assembly comprise a reinforced rubber material.

7. The play system of claim 1, wherein the plate comprises a first steel plate and a second steel plate, wherein the first steel plate couples to a top of the flexible portion and the second steel plate couples to a bottom of the flexible portion.

8. The play system of claim 1, wherein the belt comprises ascending portions and flat portions.

9. The play system of claim 1, further comprising a slide and tunnel that are both coupled to the belt at different heights along the belt.

10. A play system comprising:

a support structure, having a bottom end and a top end, vertically oriented relative to a surface such that the bottom end contacts the surface and the top end is above the surface;

a belt assembly having flexible portions and rigid portions that forms an ascending surface inside of the support structure such that it ascends from the bottom end of the support structure to the top end of the support structure, the ascending surface configured to allow users to ascend and descend on;

wherein the rigid portions each comprise a plate and the plates couple at least some of the flexible portions to one another; and a plurality of clamps that couple the support structure and the belt assembly.

11. The play system of claim 10, wherein the first support structure comprises a plurality of poles.

12. The play system of claim 10, further comprising a second support structure that comprises a rope structure on the interior of the belt assembly.

13. The play system of claim 12, where at least one of the plurality of clamps comprises:

a belt clamping end configured to couple to an end of one of the plates; and a rope clamping end configured to couple to a rope of the second support structure.

14. The play system of claim 13, wherein the at least one of the plurality of clamps comprises a first fastener configured to tighten the belt clamping end and a second fastener configured to tighten the rope clamping end.

15. The play system of claim 10, wherein at least one of the plates in the plurality of rigid portions comprises:

a first set of fasteners configured to couple to a first flexible portion in the belt assembly; and a second set of fasteners configured to couple to a second flexible portion in the belt assembly.

16. The play system of claim 10, wherein the plurality of flexible portions comprise a textured rubber material.

17. The play system of claim 10, wherein the belt path that vertically ascends in a circular shape.

18. The play system of claim 10, wherein the belt ascending surface comprises ascending portions and flat portions.

19. A play structure comprising:

a support structure comprising a plurality of rigid support poles, the support structure having a bottom end and a top end, vertically oriented relative to a surface such that the bottom end contacts the surface and the top end is above the surface;

a plurality of vertical ropes disposed within, and supported, at least in part by, the support structure;

a belt assembly having a plurality of flexible portions and a plurality of rigid portions that forms an ascending surface inside of the support structure such that it ascends from the bottom end of the support structure to the top end of the support structure;

wherein the plurality of rigid portions comprises a plurality of plates, each plate having a first end coupled to one of the plurality of rigid support poles and a second end coupled to one of the plurality of vertical ropes, the plurality of plates ascending helically around the plurality of vertical ropes; and wherein the plurality of flexible portions comprises a plurality of belts, each belt coupled on a first end to one of the plurality of plates and coupled on a second end to another one of the plurality of plates.

* * * * *